250-506.1 SR

XR 4,175,669

United Sta

Housholder et a.

[11] 4,175,669

[45] Nov. 27, 1979

[54] OVERPACK FOR NUCLEAR FUEL CONTAINER

[76] Inventors: William R. Housholder, 807 Mullins St., Johnson City, Tenn. 37601; Norman L. Greer, 1409 Central Ave., Elizabethton, Tenn. 37643

[21] Appl. No.: 701,893

[22] Filed: Jul. 1, 1976

[51] Int. Cl.[2] ..... B65D 7/02

[52] U.S. Cl. ..... 220/5 A; 220/466; 220/464; 220/85 K; 220/324; 250/506; 250/517

[58] Field of Search ..... 220/11, 65, 9 LG, 5 A, 220/5 R, 324, 85 K, DIG. 18; 150/52 F, 52 H; 250/496, 506, 517; 206/521

[56] References Cited

U.S. PATENT DOCUMENTS

| | | | |
|---|---|---|---|
| 2,968,161 | 1/1961 | Bliss | 220/9 LG |
| 3,055,532 | 9/1962 | Morrison | 220/65 |
| 3,464,579 | 9/1969 | Asenbauer | 220/324 |
| 3,500,994 | 3/1970 | Gillespie | 220/4 E |
| 3,754,140 | 8/1973 | Beierle | 250/506 |

FOREIGN PATENT DOCUMENTS

| | | | |
|---|---|---|---|
| 44-10358 | 5/1969 | Japan | 250/506 |

*Primary Examiner*—William Price
*Assistant Examiner*—Joseph Man-Fu Moy

[57] ABSTRACT

Disclosed is an overpack for nuclear fuel containers comprising longitudinally split halves or segments of dual, spaced, and sealed metal walls containing therebetween layered wood planks oriented in a special way, a stepped moisture seal around the open or chord edges of the segments, a drainage system connecting the interior of the assembled overpack to the exterior, specially constructed end bumper and skid plate assemblies, and unique toggle clamping means.

4 Claims, 8 Drawing Figures

OVERPACK FOR NUCLEAR FUEL CONTAINER

This invention concerns an overpack for nuclear fuel containers, comprising longitudinally split halves or segments of dual, spaced, and sealed metal walls containing therebetween layered wood planks oriented in a special way, a stepped moisture seal around the open or chord edges of the segments, a drainage system connecting the interior of the assembled overpack to the exterior, specially constructed end bumper and skid plate assemblies, and unique toggle clamping means.

The present overpack involves special construction and design for highway transportation of radioactive materials, including solid, liquid or gaseous nuclear fuel, such as $UF_6$, or nuclear waste. The growing use of nuclear reactors for power purposes necessitates the transportation of radioactive materials in considerable volume to fuel reclaiming, enrichment, and remote disposal sites. It is essential that the radioactive material be transported within a package designed within the weight limits applicable to highway transport vehicles and capable of safely containing the material in the event of serious accident. The design of the present overpack is such that it is capable of withstanding extremely rigorous accident conditions and just about any impact load to which the assembly of fuel container and overpack might be subjected during highway transport. The overpack is readily carried on a truck bed and is designed to absorb impact forces without rupture of itself and the inner fuel container.

The performance requirements which the present overpack meets and surpasses include the following:

1. A 30-foot drop test impacting at three different attitudes as follows:
   - (a) Impacting flat on bottom—kinetic energy absorbed by crushing wood to a depth of about $5\frac{1}{2}$ inches;
   - (b) Impacting flat on end—kinetic energy absorbed by crushing wood to a depth of about 4 inches;
   - (c) Impacting with center-of-gravity over end corner—kinetic energy absorbed by crushing wood to a depth of about $9\frac{1}{2}$ inches at the corner which corresponds to a depth of about $6\frac{1}{4}$ inches at the closest point to the inner shell.
2. A puncture test comprising a 40-inch drop onto a 6-inch diameter piston as follows:
   - (a) Impacting on side over center-of-gravity—kinetic energy absorbed by crushing wood to a depth of about 7 inches without shearing the outer shell. This causes deformation of the cylinder stiffener ring when it is under the point of impact; the cylinder is not otherwise damaged;
   - (b) Impacting on side on the 11-gage shell near the end of the $\frac{1}{4}$-inch puncture barrier plate—the outer shell shears and the kinetic energy is absorbed by shearing and crushing the wood under the piston to a depth of about $6\frac{1}{2}$ inches. The cylinder is undamaged;
   - (c) Impacting on end over the center-of-gravity—the end plate does not shear and the kinetic energy is absorbed by crushing the wood to a depth of about 7 inches. There is no damage to the cylinder.
3. A fire test at 1475° F. for $\frac{1}{2}$ hour. About 18,000 Btu of heat transfers to the inner shell through the wood insulation and through the metal step plates causing a temperature rise of less than 10° F. in the inner shell. About $\frac{1}{3}$ of this heat is concentrated near the step plates.

Additional heat is transferred to the inner shell at damaged locations causing warm spots in the inner shell. Heat transferred to the cylinder from the inner shell is somewhat more uniform because it has to transfer across a $\frac{1}{2}$-inch air gap and through the neoprene pads. In any case the $\frac{1}{2}$-hour fire test causes an insignificant temperature rise in the $UF_6$ cylinder with some warm spots at damaged points in the overpack. There is no danger of vaporizing any $UF_6$.

SUMMARY OF THE INVENTION

The invention described herein concerns an overpack for an inner containment vessel and comprises in its broad sense an elongated shell split longitudinally into an upper section and a lower section, each of said sections comprising dual, spaced, and sealed metal side and end walls tightly surrounding layered specially oriented wood planks and welded together in an essentially airtight manner, said upper section having a projection on the periphery of its chord face, said lower section having a recess in the periphery of its chord face adapted to receive said projection in a nesting manner, conduit means in said lower section extending substantially longitudinally and radially inwardly therethrough, and clamping means on said sections for removably securing said sections together.

Objects of the invention are:

To provide an enormously strong overpack for nuclear material vessels, which is very lightweight in proportion to its impact strength;

To provide such an overpack having very effective heat shielding under extreme fire conditions over extended periods; and To provide such an overpack with structural features which enable convenient and rapid loading an unloading of the inner containment vessel.

These and further objects will be evident from the following disclosure, taken also with the accompanying drawings which illustrate a preferred form of the invention. It is to be understood that the details of the preferred construction are only illustrative and that modifications might be made within the scope of this disclosure.

Figure 1:
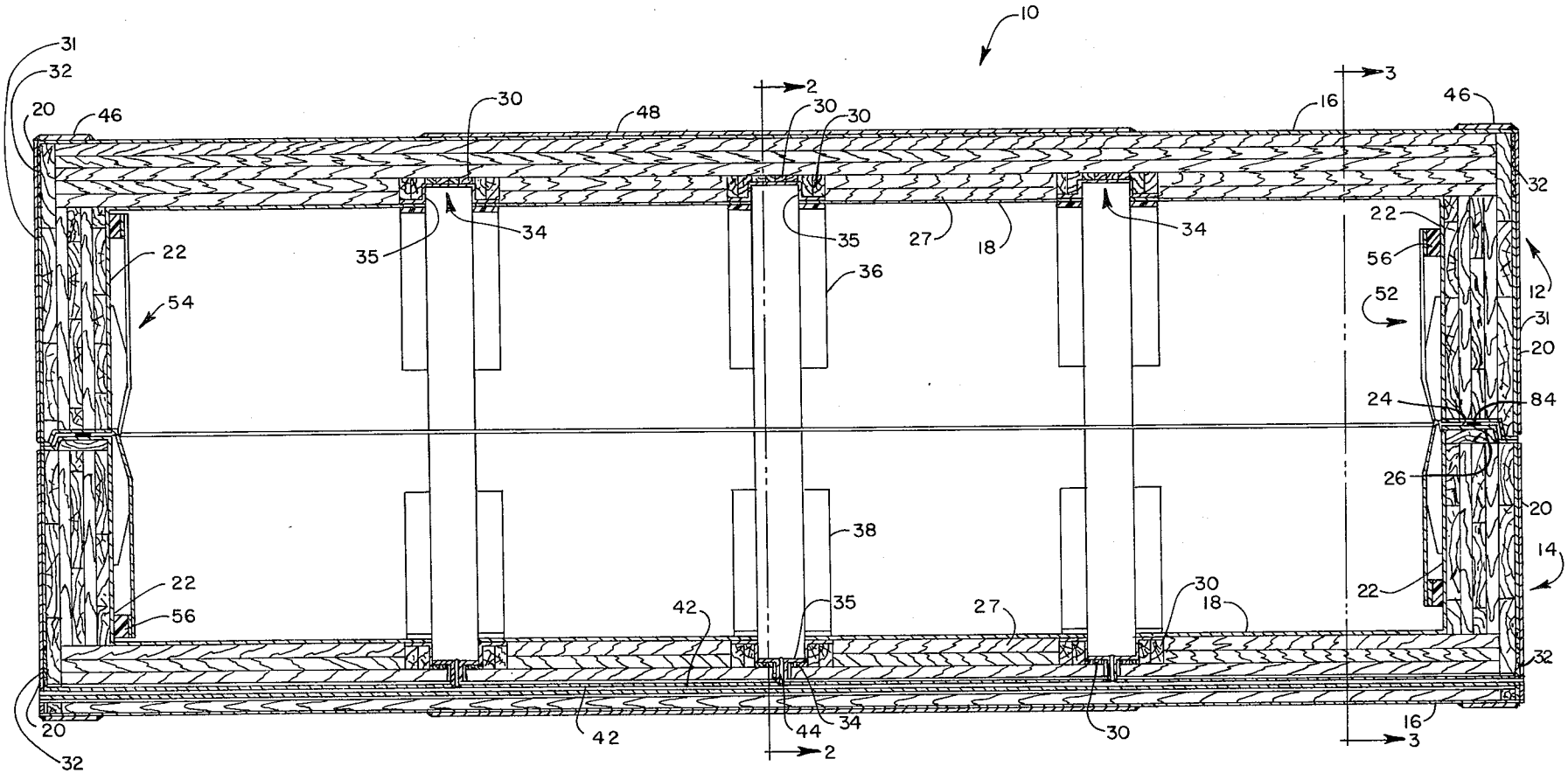
FIG. 1 is a longitudinal cross-sectional view of the overpack.
Figure 3:
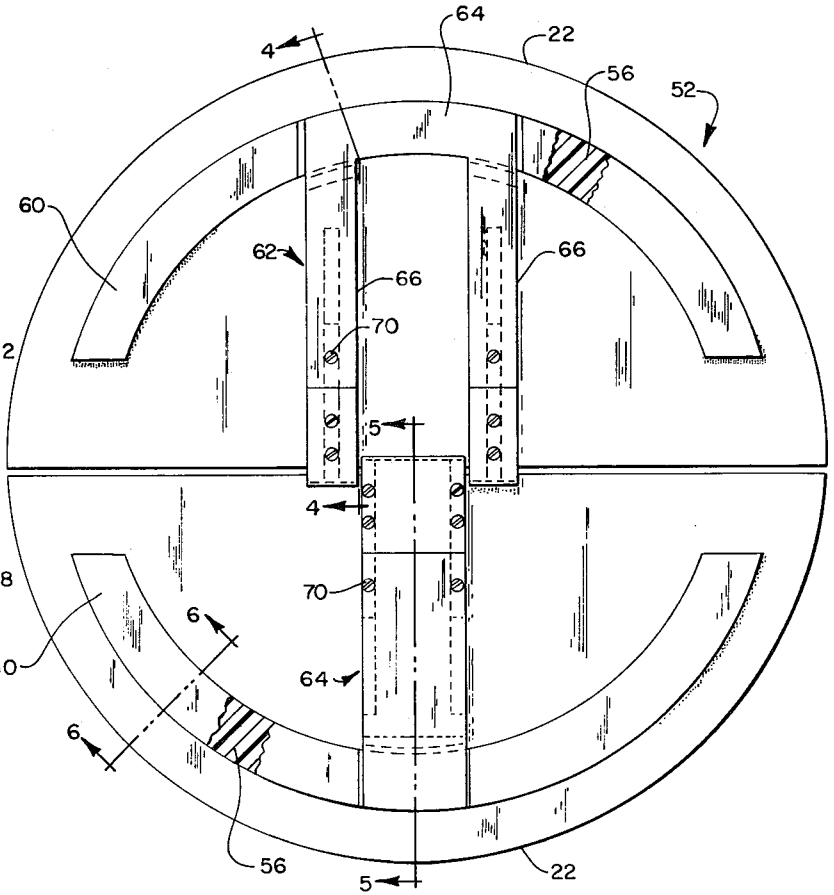
FIG. 3 is a plan view of an end plate assembly taken along line 3—3 of FIG. 1 with the overpack sides in outline.
Figure 2:
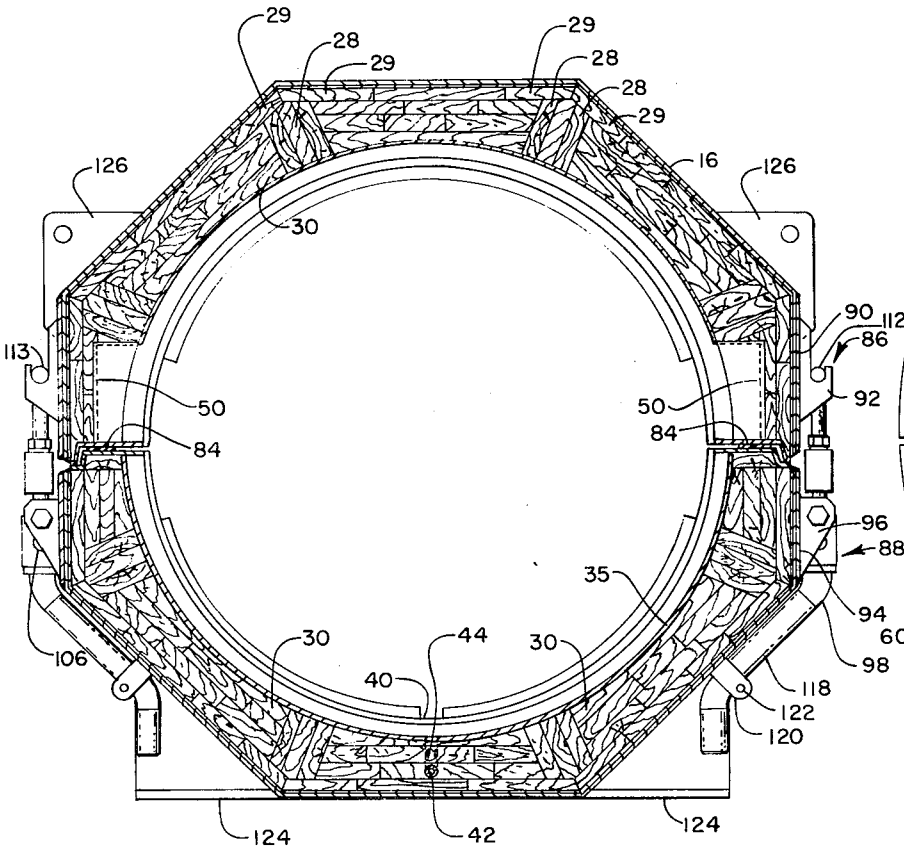
FIG. 2 is a cross-sectional view of the overpack taken along line 2—2 of FIG. 1.
Figure 6:
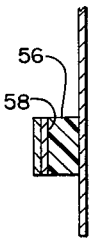
FIG. 6 is a sectional view taken along line 6—6 of FIG. 3.

Referring to the drawings wherein certain of the dimensions, particularly wall thickness, are enlarged for purposes of visual clarity, the overpack 10 comprises an elongated shell comprising roughly equal size upper 12 and lower 14 sections. Each section comprises an outer side wall 16, inner side wall 18, outer end wall 20, and inner end wall 22. A step plate 24 is provided on the upper section, and a mating step plate 26 on the lower section. These metal walls and plates, preferably stainless steel, are welded together to provide essentially airtight halves. Wood planking 27, preferably Western Spruce, structural grade, number 1 common or better with not more than about 12% moisture, is oriented as shown, assembled, tightly glued, and nailed together within the walls prior to the walls being seal welded. This orientation of the planking gives surprisingly increased impact cushioning to the overpack; and particular emphasis is placed on the orientation as shown in FIG. 2 of the radially edge oriented planks 28 overlaid with tangential flat oriented planks 29 and in FIG. 1 the circumferentially curved wood cradle 30.

Positioned under the end walls 20 are half moon shaped end puncture barriers 31 which give enormous endwise puncture resistance. Plywood end rings 32 space and support the periphery of the end wall 20.

Circumferential grooves 34 lined with heavy gauge metal angle rings 35 are provided in the inner wall to accommodate conventional stiffening rings on the inner containment vessel which holds the nuclear material. Neoprene pads 36 and 38 are adhered to the upper and lower sections respectively, pads 38 being in two segments to provide a gap 40 for complete water drainage. The drainage system comprises the longitudinally extending conduit 42 and branches 44 and effectively drains the lower section of any water which may tend to collect therein. Strengthening end bands 46 and puncture barrier 48 are welded to the outer side walls. As shown in FIG. 2, recesses 50 are provided wherever necessary to accommodate lifting lugs provided on the inner containment vessel.

Referring to FIGS. 3–7, the metal end plate assemblies 52 and 54, preferably stainless steel, are essentially the same except 52 is smaller in diameter. These assemblies comprise the inner end plate 22, neoprene bumper 56 adhesively secured to end plate 22 and to a bumper plate ring 58, bumper plate segment 60 seal welded to ring 58, upper skid plate 62 and lower skid plate 64.

Skid plate 62 comprises a slotted member having an arcuate web 64 and arms 66 bolted to brackets 68 by countersunk screw bolts 70 preferably installed with Loctite adhesive. Brackets 68 are welded to the inner end plate. Stops 72 are welded to arms 66 to prevent radial force from sliding the skid plate on the bumper plate ring 58 beyond the bumper 56. Lower skid plate 64 is constructed the same as 62 except for the obvious difference in shape. The bevelled ends 74 of the skid plates insure a smooth sliding entry of the inner containment vessel into sections 12 and 14.

Figure 7:
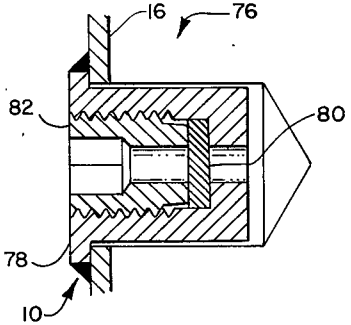
FIG. 7 is a cross-sectional view of a vent plug.
Figure 5:
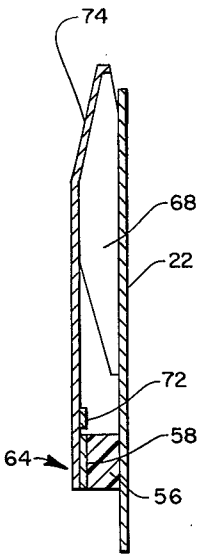
FIG. 5 is a sectional view taken along line 5—5 of FIG. 3.
Figure 4:
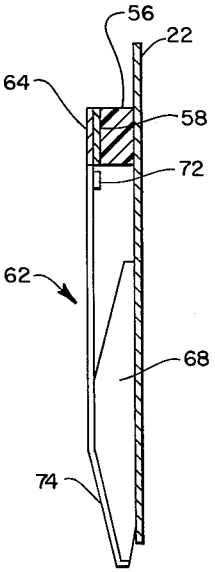
FIG. 4 is a sectional view taken along line 4—4 of FIG. 3.

Referring to FIG. 7, vent assembly 76 is shown to comprise a flanged body 78 welded to outer side wall 16. A lead rupture disc 80 is compressively sealed between body 78 and plug 82 screwed into the body. These vent assemblies are provided in an appropriate number and location to insure proper venting of the sections under severe heating conditions which might otherwise generate sufficient pressure to rupture the walls themselves.

Figure 8:
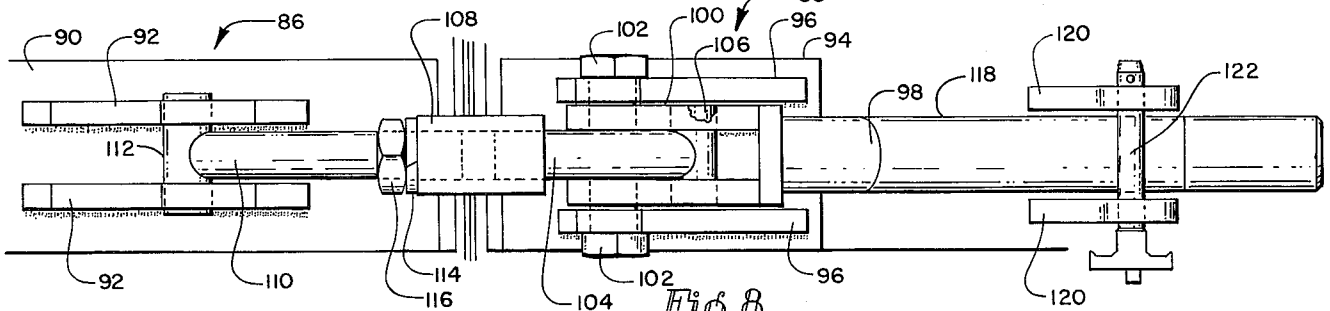
FIG. 8 is a plan view of the clamping or toggle mechanism.

Referring to FIGS. 2 and 8, the clamping mechanism which holds the two sections rigidly and tightly together with neoprene seal 84 compressed all the way around the chord faces, are upper 86 and lower 88 toggle assemblies longitudinally spaced on the overpack shell. The upper assemblies 86 comprise a base 90 welded to the outer wall 16 and to spaced hangers 92. The lower assemblies 88 comprise base 94 welded to the outer wall 16, spaced brackets 96 welded on base 94, toggle arm 98 with clevis 100, shoulder bolts 102 threaded into brackets 96 and rotatably journaled in the arms of clevis 100. A T-bolt 104 has shaft 106 also rotatably journaled in the clevis arms, and has a threaded, adjustable coupling 108 which is also threaded onto another T-bolt 110 having shaft 112 for engaging in the U-shaped top shoulders 113 of hangers 92. A lockwasher 114 and nut 116 threaded onto bolt 110 locks coupling 108 in position after the toggle assembly is adjusted to give the correct compression at the chord faces. The toggle arm 118 is uniquely shaped such that in the clamped position of the toggle, the handle is safely retracted under the overpack. A pair of lockpin brackets 120 are welded to the outer wall and are apertured to removably receive lockpin 122 of the steel ball, quick release type such as Carr-Lane No. CL-12-BLP-T-4.5S with cable, which secures the toggle handle in its clamped position. Feet 124 are welded onto the outer shell in appropriate locations and may be apertured to receive hold down bolts or equivalent means. Lifting lugs 126 are welded to the outer wall wherever necessary.

The invention has been described in detail with particular reference to preferred embodiments thereof, but it will be understood that variations and modifications can be effected within the spirit and scope of the invention.

We claim:

1. An overpack having an elongated shell split longitudinally into an upper section and a lower section, each of said sections comprising dual, spaced, and sealed metal side and end walls tightly surrounding layered oriented wood planks and welded together in an essentially airtight manner, said upper section having a projection on the periphery of its chord face, said lower section having a recess in the periphery of its chord face adapted to receive said projection in a nesting manner, a compressible seal between said chord faces, conduit means in said lower section extending generally longitudinally and radially inwardly therethrough, a plurality of toggle units longitudinally spaced along each side of the outer walls of said sections, for removably securing said sections together, each of said inner end walls being provided with a bumper assembly comprising arcuate, spaced segments of cushioning material secured at their outer surfaces to the end wall at a position adjacent the periphery thereof and carrying on their inner surfaces a metal bumper plate, and a skid assembly secured to each end wall and extending radially from between said segments to a point beyond the chord of the end wall, said skid assembly comprising at least one bracket member secured at its outer surface to the end wall and removably carrying on its inner surface a skid plate, cushioning material secured to the end wall and carrying a metal plate on its inner surface in sliding contact with said skid plate.

2. The overpack of claim 1 wherein the skid plate is free to flex at its end adjacent the cushioning material.

3. The overpack of claim 2 wherein the cross-sectional configuration of the assembled sections is octagonal and the handles of the toggle units in the clamped position are curved under the overpack.

4. The overpack of claim 3 wherein the planks at the octagonal corners are radially edge oriented and overlaid with tangentially oriented planks.

* * * * *